US008050145B2

(12) United States Patent
Ostrovsky et al.

(10) Patent No.: US 8,050,145 B2
(45) Date of Patent: Nov. 1, 2011

(54) WALL MOUNTED PROGRAMMABLE TIMER SYSTEM

(75) Inventors: Michael Ostrovsky, Brooklyn, NY (US); Alfred Lombardi, Syosset, NY (US); Selin Tansi Glickman, Woodbury, NY (US); Cheryl Samartano, North Baldwin, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 641 days.

(21) Appl. No.: 12/037,922

(22) Filed: Feb. 26, 2008

(65) Prior Publication Data

US 2009/0213698 A1 Aug. 27, 2009

(51) Int. Cl.
*G04B 47/00* (2006.01)
*G04F 8/00* (2006.01)
*H01H 7/00* (2006.01)

(52) U.S. Cl. ..... 368/10; 368/107; 307/141; 439/536

(58) Field of Classification Search ..... 368/10, 368/107–109; 174/53–55, 66–67; 200/5 R, 200/5 A, 5 E, 33 R, 35 R, 37 R, 308–310, 200/313; 307/140, 141, 141.4; 340/309.16, 340/309.4–309.8; 439/535, 536
See application file for complete search history.

(56) References Cited

U.S. PATENT DOCUMENTS

| | | | | |
|---|---|---|---|---|
| 3,473,107 | A | | 10/1969 | Smalley |
| 3,555,367 | A | | 1/1971 | Watson |
| 3,598,937 | A | | 8/1971 | Balchunas |
| 3,711,761 | A | | 1/1973 | Watson |
| 3,740,680 | A | | 6/1973 | Schneidinger |
| 3,889,132 | A | * | 6/1975 | Vreeland ..... 307/141 |
| 3,939,361 | A | | 2/1976 | Aidala et al. |
| 3,979,601 | A | | 9/1976 | Franklin |
| 3,988,553 | A | | 10/1976 | Astle |
| 4,002,925 | A | | 1/1977 | Monahan |
| 4,112,313 | A | | 9/1978 | Kutin |
| 4,194,182 | A | | 3/1980 | Martin |
| 4,336,464 | A | | 6/1982 | Weber |
| 4,338,562 | A | | 7/1982 | Terwilliger |
| 4,349,748 | A | | 9/1982 | Goldstein et al. |
| 4,360,739 | A | | 11/1982 | Goldstein |
| 4,400,699 | A | * | 8/1983 | Glasmacher ..... 340/825.22 |
| 4,422,018 | A | | 12/1983 | Bailey |
| 4,431,893 | A | * | 2/1984 | Levie ..... 219/719 |
| 4,439,688 | A | | 3/1984 | Schornack |
| D273,488 | S | | 4/1984 | Rosenbaum et al. |
| D273,581 | S | | 4/1984 | Rosenbaum et al. |
| 4,440,503 | A | | 4/1984 | Arichi et al. |
| 4,494,012 | A | | 1/1985 | Coker |
| RE31,848 | E | | 3/1985 | Nilssen |
| 4,533,972 | A | | 8/1985 | Ohashi |
| D285,419 | S | | 9/1986 | Schwartz |

(Continued)

FOREIGN PATENT DOCUMENTS

EP 0141655 B1 5/1985

(Continued)

*Primary Examiner* — Vit Miska
(74) *Attorney, Agent, or Firm* — Collard & Roe, P.C.

(57) ABSTRACT

A timing device is disclosed which is for controlling electronic devices and which is mounted in a wall switch box. This timing device comprises at least one controller, at least one transceiver in communication with the controller, at least one interface; and at least one cover plate. This device can also include at least one key coupled to the cover plate for interacting with the interface when said cover plate is inserted onto said at least one interface.

26 Claims, 9 Drawing Sheets

U.S. PATENT DOCUMENTS

| | | | | | |
|---|---|---|---|---|---|
| 4,668,878 | A | | 5/1987 | Wyss | |
| 4,777,384 | A | | 10/1988 | Altenhof et al. | |
| 4,835,413 | A | | 5/1989 | Nilssen | |
| 4,950,913 | A | | 8/1990 | Kephart | |
| 5,063,355 | A | | 11/1991 | Sasaki et al. | |
| 5,264,761 | A | * | 11/1993 | Johnson | 315/291 |
| 5,349,344 | A | * | 9/1994 | Head | 340/825.23 |
| 5,397,930 | A | | 3/1995 | Nilssen | |
| 5,448,630 | A | * | 9/1995 | Barstow | 379/199 |
| 5,481,452 | A | * | 1/1996 | Simmons | 700/12 |
| 5,508,878 | A | | 4/1996 | Pecore | |
| 5,650,716 | A | | 7/1997 | Kim | |
| 5,753,983 | A | * | 5/1998 | Dickie et al. | 307/141.4 |
| 5,955,796 | A | * | 9/1999 | Nilssen | 307/140 |
| 6,060,980 | A | * | 5/2000 | Bedol | 340/309.7 |
| 6,121,889 | A | * | 9/2000 | Janda et al. | 340/815.47 |
| 6,388,952 | B2 | | 5/2002 | Kim | |
| 6,933,686 | B1 | | 8/2005 | Bishel | |
| 7,394,367 | B1 | * | 7/2008 | Aupperle et al. | 340/540 |
| 7,563,131 | B2 | * | 7/2009 | Sullivan et al. | 439/535 |
| 7,683,504 | B2 | * | 3/2010 | Blair et al. | 307/141 |
| 2003/0098888 | A1 | * | 5/2003 | Guenther et al. | 345/810 |
| 2004/0178683 | A1 | * | 9/2004 | Hermetz et al. | 307/141 |
| 2007/0275595 | A1 | * | 11/2007 | Hazani et al. | 439/536 |
| 2008/0061633 | A1 | | 3/2008 | Blair et al. | |

FOREIGN PATENT DOCUMENTS

| | | | |
|---|---|---|---|
| EP | 0156864 | B1 | 10/1985 |
| EP | 0167848 | B1 | 1/1986 |
| EP | 0259639 | B1 | 3/1988 |
| EP | 0316913 | A2 | 5/1989 |
| EP | 0376409 | A2 | 7/1990 |
| EP | 0394654 | B1 | 10/1990 |
| EP | 0730209 | B1 | 9/1996 |
| EP | 0745914 | B1 | 12/1996 |
| WO | WO 81/02808 | | 10/1981 |

* cited by examiner

WALL MOUNTED PROGRAMMABLE TIMER SYSTEM

BACKGROUND

At least one embodiment of the invention relates to a programmable wall mounted timer for controlling electronic components. This wall mounted timer can be programmed with a plurality of different settings.

Other wall mounted timers are known in the art. For example, U.S. Pat. No. 6,121,889 to Janda discloses an in-wall electronic timer having a user interface. In addition, U.S. Pat. No. 5,638,947 to Finne which issued on Jun. 17, 1997 discloses a modular timer having multiple finished extension members.

However, there continues to be a need for a wall mounted timer which is easy to install in a standard wall mounted electrical box, which can be used in a single and multiple ganged electrical boxes which blend with other dimmers and switches. In at least one instance, these timers can be controlled from multiple locations wherein settings can be adjusted based on a user's need from minutes to hours.

SUMMARY

At least one embodiment of the invention relates to a wall mounted timer for use in controlling at least one component. The wall mounted timer can be easily programmed so that it is adaptable in a plurality of different situations. The timer can be programmed in any number of ways. For example, the wall mounted timer can have a face plate that has at least one interface which forms a key having a setting to indicate how many timer settings are to be indicated on a face of the device. When the face plate is coupled to the body or the housing of the device, this preconfigures the device so that at least one embodiment is now set with a particular number of lights or indications, and can be optionally set with a particular timer settings for these lights or indications.

Alternatively, the wall mounted timer can be programmed via a second interface comprising any number of rocker buttons, dimmer switches or push buttons, coupled to actuators, such that when a user presses on these buttons or switches in a particular manner, the user can program the timer condition including the number of timer settings, and a particular time for each timer setting.

Another manner for adjusting or programming the timer is through wireless communication. The timer can also communicate wirelessly with a remote control, wherein this remote control can have any number of buttons or switches coupled to actuators which when pressed in a particular manner, result in communications being sent to the timer to program the timer condition, including the number of timer settings and to set a particular time for each timer setting.

The three different ways for adjusting the timer settings or timer condition can be used together in a hybrid manner so that at least one embodiment includes an adjustable timer that can be adjusted by all three of the above methods, including adjusting the timer setting via a key and interface, adjusting the timer setting via the interface on the housing, and adjusting the timer settings via wireless transmission.

Along with this universal programmability, the timer is also adjustable in appearance. Depending on the number of timer times set, and the time periods for each timer time, different face plates or labels can be coupled to the timer to reflect the timer condition programmed into the timer.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION

Figure 1:
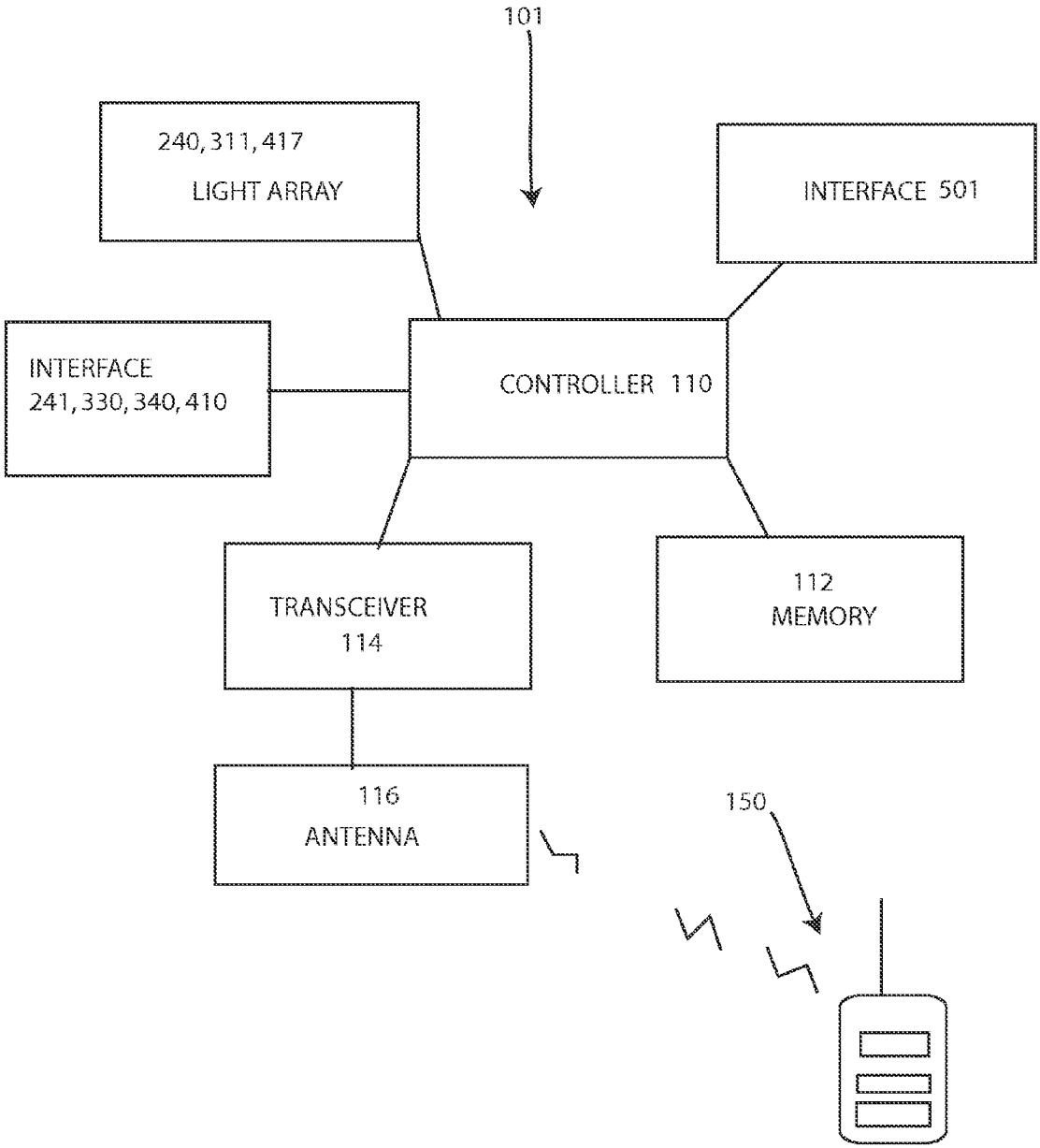
FIG. 1 is a schematic block diagram of electrical components associated with the embodiments shown in FIGS. 2-5.

FIG. 1 shows a schematic block diagram of the electronic components 101 of the timer device shown in FIGS. 2-5. For example, this design can be incorporated into any one of the housings in any one of the embodiments 200, 300, 400 and 500. This design includes a series of electronic components 101 which are used to control the setting of this timer system. The components can be in any form of components but in this example, include a controller 110 such as a microprocessor. A memory 112 is in communication with controller 110 which stores settings and a controlling program to instruct controller 110. Memory 112 is shown as one unit, and can be in the form of a flash memory such as an EEPROM or in the form of multiple memory units. In addition, a transceiver 114 is in communication with controller 110 as well as an antenna 116 which is in communication with transceiver 114. There is also a light array in communication with controller 110 which can be in the form of light array 240, light array 311, or light array 427 shown in FIGS. 2, 3 and 4. Controller 110 is also in communication with optional interface 501 (See FIG. 5) wherein controller 110 receives information from interface 501, and stores this information in memory 112.

In addition, there is also an interface which corresponds to any one of interfaces or series of buttons 241, 330, 340, and 410 which may be coupled to associated actuators disposed inside the housing in a known manner and used to control the timer settings and program the timer settings. These interfaces, in the form of associated buttons paddles or switches, can be pressed in particular sequences to relay new timer settings to controller 110. The program stored in memory 112, has values associated with the pressing of buttons on the controller so that these instructions sent to controller 110 are then stored in memory 112 and operated on by controller 110 to either change a desired time of an associated timer setting, switch to a particular timer countdown, or remove timer settings as well.

Another way to program or interface with controller 110 is through wireless transmission of information to controller 110. For example, a remote control 150 can be used to set the timer condition of the timer including the number of timer settings and the time periods for each setting. As disclosed above, the timer settings can be controlled wirelessly by relaying information from remote control 150 to controller 110 through antenna 116 and transceiver 114 and then setting the appropriate number of timer settings, setting the desired timer increments, or setting a particular time for counting down, and then storing these characteristics in memory 112. The antenna system 116 can be formed in any suitable manner such as a manner similar to that shown in U.S. patent application Ser. No. 11/559,646, filed on Nov. 14, 2006, the disclosure of which is hereby incorporated herein by reference.

Figure 2:
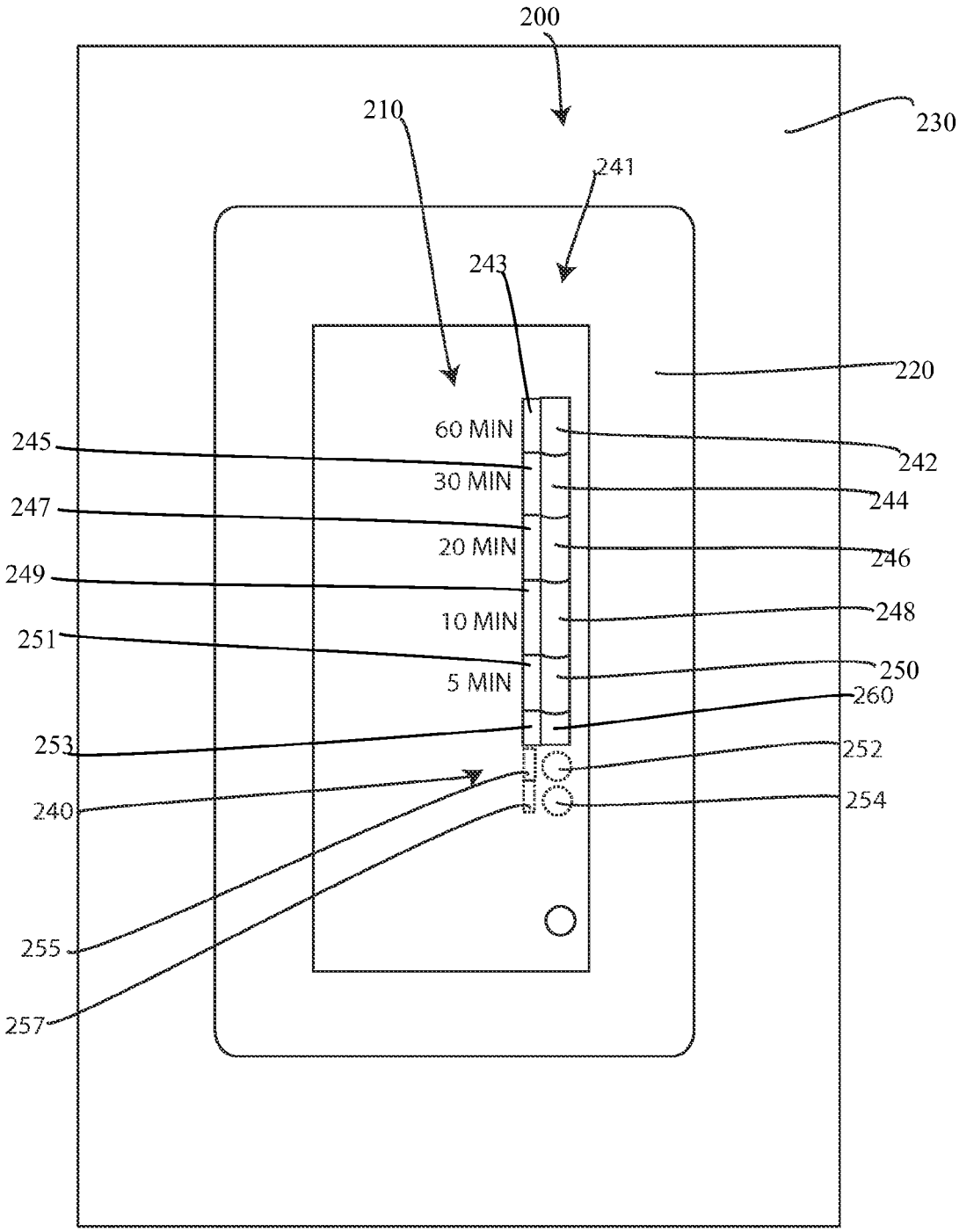
FIG. 2 is a first embodiment of the timer.

FIG. 2 is a front view of a first embodiment of the timer 200. With this view, there are multiple lights shown, each with a different setting. There are indicia disposed on a front face, which can be either pre-printed thereon, placed thereon with a label, or omitted depending on the user's desire. This indicia indicates the amount of time left in each timer setting. Shown in FIG. 2 are the time intervals 5, 10, 20, 30, and 60 minutes. These time intervals are shown for illustrative purposes only and the intervals may be set to any suitable lengths of time as desired by the user. Timer 200, as shown, includes an inner cover plate 210, an intermediate outer face plate 220 and an additional outer face plate 230. A series of buttons 241 including buttons 242, 244, 246, 248, and 250 and 260 are disposed on the front face adjacent to the light array 240 which for example, includes associated indicating lights 243, 245, 247, 249, 251, and 253. In this case, these indicating lights can be in the form of LED indicating lights that are disposed behind a light pipe. The number of exposed lights on this face are controlled by the size and shape of cover plate 210 which is coupled to face plate 220. For example, in this embodiment, unused actuators 252 and 254 are shown by dashed circles and are disposed beneath cover plate 210. These unused actuators are consequently programmed to be inactive based upon the instructions sent by a user. Thus, these unused actuators are covered by plate 210. Similarly, unused lights 255 and 257 are shown by dashed lines disposed beneath and covered by plate 210.

The settings relating to the number of lights, and the number of buttons is controlled by either pressing on particular buttons 242-260, through wirelessly sending instructions from a remote control or through the insertion of a unique faceplate. An example of this process is shown by way of example in FIGS. 7 and 8.

This face shows an example of settings wherein with these settings, button 242 when pressed, selects the 60 minute time period which then activates the 60 minute LED light 243. In addition, the 30 minute button 244 can then be selectively pressed to set the 30 minute time period which then activates the 30 minute light 245 to indicate that this time has been set as well. Accordingly, the 20 minute button 246 can be pressed which then activates the 20 minute light 247 which sets this time. Other buttons such as ten minute button 248 or five minute button 250 can be pressed to set these times as well. Alternately, the unit can be programmed such that any suitable button, or buttons, can activate and suitable light, or lights.

Figure 3:
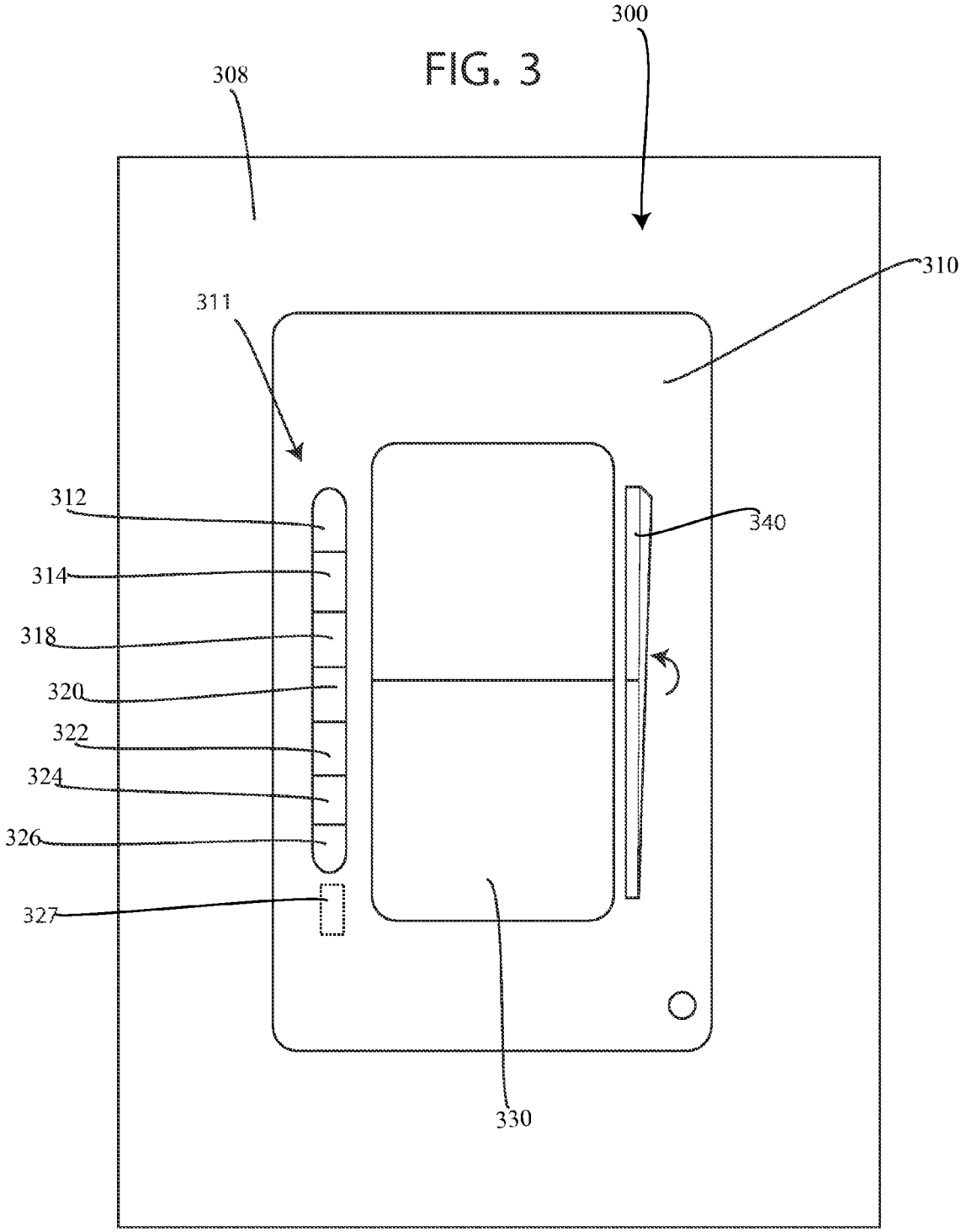
FIG. 3 is another embodiment of the timer.

FIG. 3 is a front view of another embodiment 300. With this embodiment, there is a front plate 308 which is coupled to a cover plate 310. In addition, a rocker paddle 330 is coupled to plate 310 wherein this entire assembly can be stored into a single gang electrical enclosure. There is also a series of lights in a light array 311. These lights are 312, 314, 318, 320, 322, 324, 326 and 327 (shown covered) which indicate, in this case, a particular time for counting down. In addition, there is also a dimmer button 340 which may be used to program the device. For example, as explained in step 1001, (See FIG. 10) the paddle 330 can be pressed along with dimmer button 340 to set a particular time. For example, if the user presses both the rocker paddle 330 and the dimmer button 340 then the user can preset a particular time as indicated by LED lights 312, 314, 318, 320, 322, 324, and 326. By pressing the rocker paddle 330 up along with dimmer button 340, the highest timer setting 312 can be set. Alternatively, once this time is selected a user can scroll down to lower times by pressing on the down section of rocker paddle 330 so that the lower times are set as well.

Therefore, the user can then scroll down from a highest setting as indicated by light 312 down to a next highest setting as indicated by light 314, to a next highest setting as indicated by light 318, down to the additional settings associated with lights 320, 322, 324, and 326. Alternatively, the process for programming this embodiment can be used to program dimmer intensity levels as well. Instead of using the process for program timers, a dimmer can be set wherein the dimmer setting can be set by scrolling through or setting a highest dimmer setting as designated by light 312 and then scrolled down to lower dimmer levels indicated by lights 314, 318, 322, 324, 326, and 327. Likewise, any other suitable electrical load could be controlled by this embodiment such as, but not limited to, motors, appliances, lamp shades, and so on.

Thus, by pressing rocker paddle 330 up along with dimmer button 340 this sets the highest dimmer level. Once this dimmer level is set, a user can scroll down to lower dimmer settings by pressing on the down section of the rocker paddle 330. The light then scrolls down through the various dimmer levels rather than incrementally via dimmer button 340.

Figure 4:
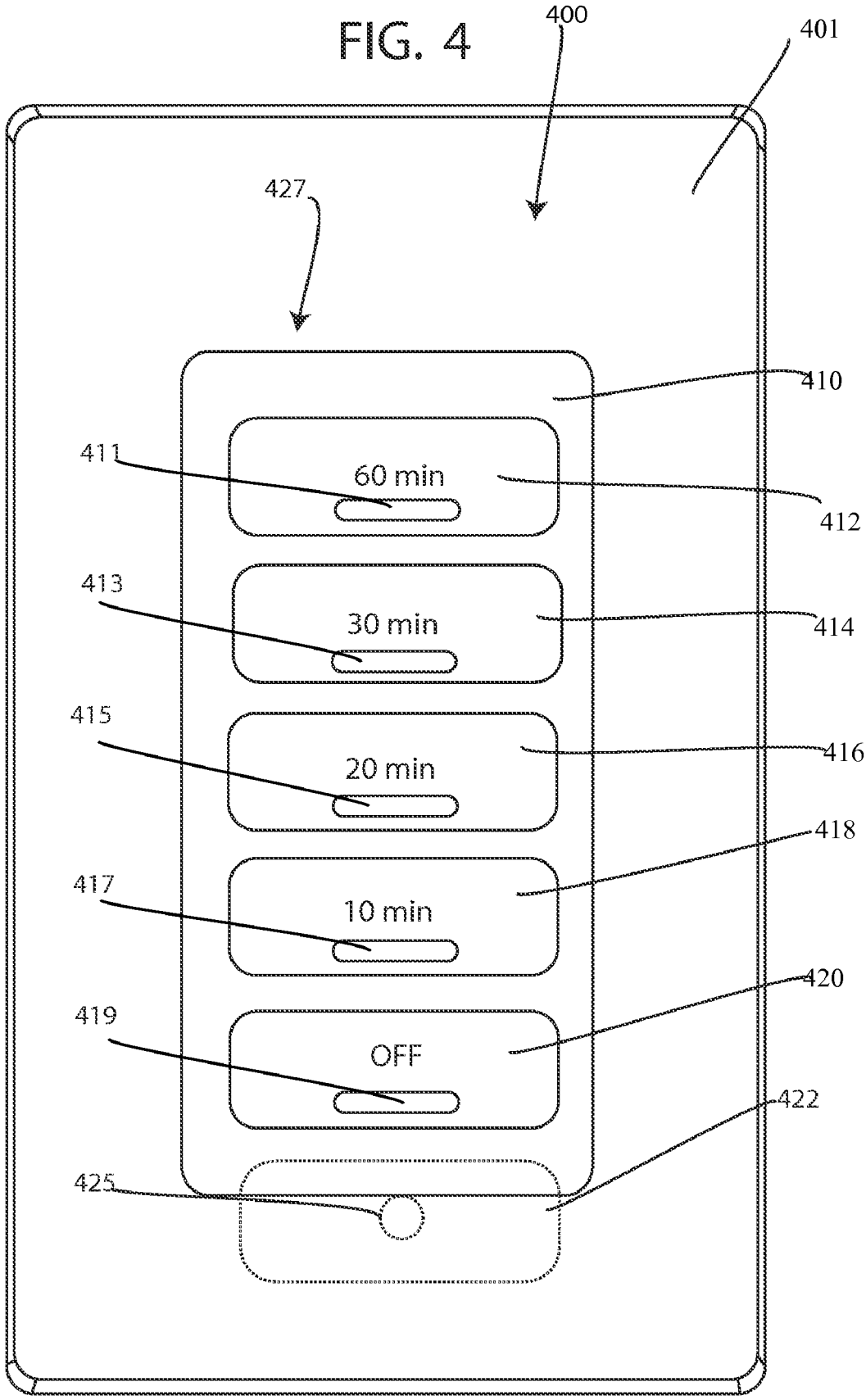
FIG. 4 is another embodiment of the timer.

FIG. 4 shows an alternative embodiment which shows a face plate 401, a cover plate 410 and a series of buttons 412, 414, 416, 418, and 420 which can be set by pressing them and holding them to set the appropriate time. Shown in FIG.4 are the time intervals 10, 20, 30, and 60 minutes. These time intervals are shown for illustrative purposes only and the intervals may be set to any suitable lengths of time as desired by the user. Alternatively, the embodiment may be programmed with any suitable method. In addition, there is a series of lights 411, 413, 415, and 417 and 419 forming a light array. For example, if button 412 is pressed and held, an associated light 411 is illuminated indicating that this time has been set. Alternatively, if button 414 is pressed and held then the associated light 413 is lit indicating that this time is to be set instead. Next, if button 416 is pressed and held, light 415 is lit indicating that this time has been preset. Next, if button 418 is pressed and held, light 417 is lit indicating that this time has been set. Alternatively, if button 420 is pressed and held, light 419 lights up indicating that the load (such as a light) has been shut down.

One way to provide an indication of the time left is if, for example, a person sets the timer to last for sixty minutes by pressing button 412. This causes light 411 to be lit, once the time period approaches the next time indication, the light 411 for example will flash and then turn off while light 413 will then turn on indicating that the timer has only thirty minutes left. The time will then progressively scroll down until it reaches the off position. A user can selectively program whether the off button should remain on or off after all of the lights have been turned off.

In addition, as shown in this embodiment, cover plate 410 and face plate 401 can be used to cover unused actuators 425 which are selectively covered by selecting a particular face. In this case, for each button, there is an associated actuator disposed in the housing and behind each button. If a user decides to limit the number of timer settings, that user can cover a particular actuator, which would not be coupled to a button, and then program controller 110 so that the covered actuator is registered as inactive.

Figure 5:
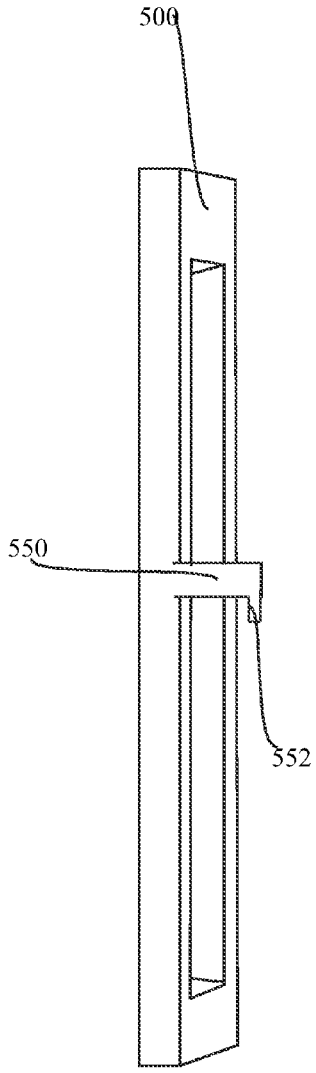
FIG. 5 is a side perspective view of a cover plate having a key.

FIG. 5 shows a side view of a plate or cover 500 having an extension member 550 and a key 552. This extension member 550 and associated key 552 are designed to interface with an associated interface 501, (See FIG. 6) having a series of different sections 510, 512, 514, 516, 518, and 520 for interaction with key 552. These different sections 510-520 may be discrete electrical contacts which are designed to send different signals or instructions to controller 110 depending on whether these contacts have been contacted by key 552. Alternatively, the interface may be optical or magnetic in nature responsive to an appropriate key. Therefore, the positioning of this key 552 on arm 550 is used to determine any one of the following: the number of desired timer settings; the number of desired lighting elements to be shown; and the times of the timer settings as well. For example, depending on the section of interface 501 that is intersected, the key 552 intersects the interface 501 in particular sections so that instructions can be sent from interface 501 to an associated processor such as controller 110 to configure the desired timer conditions.

Alternatively, this key 552 which interacts with the associated interface 501, can be used to set dimmer functions as well such that when key 552 interacts with particular sections, the information sent from interface 501 is then sent onto controller 110 as a set of instructions to pre-program a dimmer interface.

Figure 6:
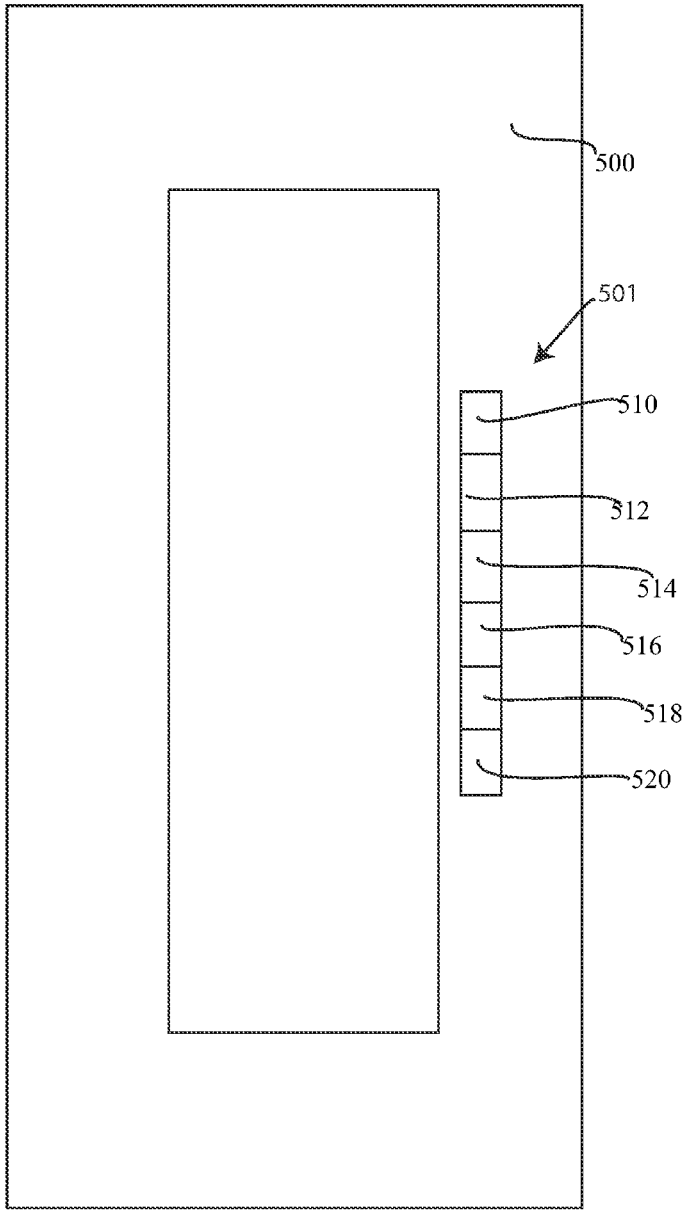
FIG. 6 is a front view of a housing having an interface for interfacing with the coverplate of FIG. 5.
Figure 7:
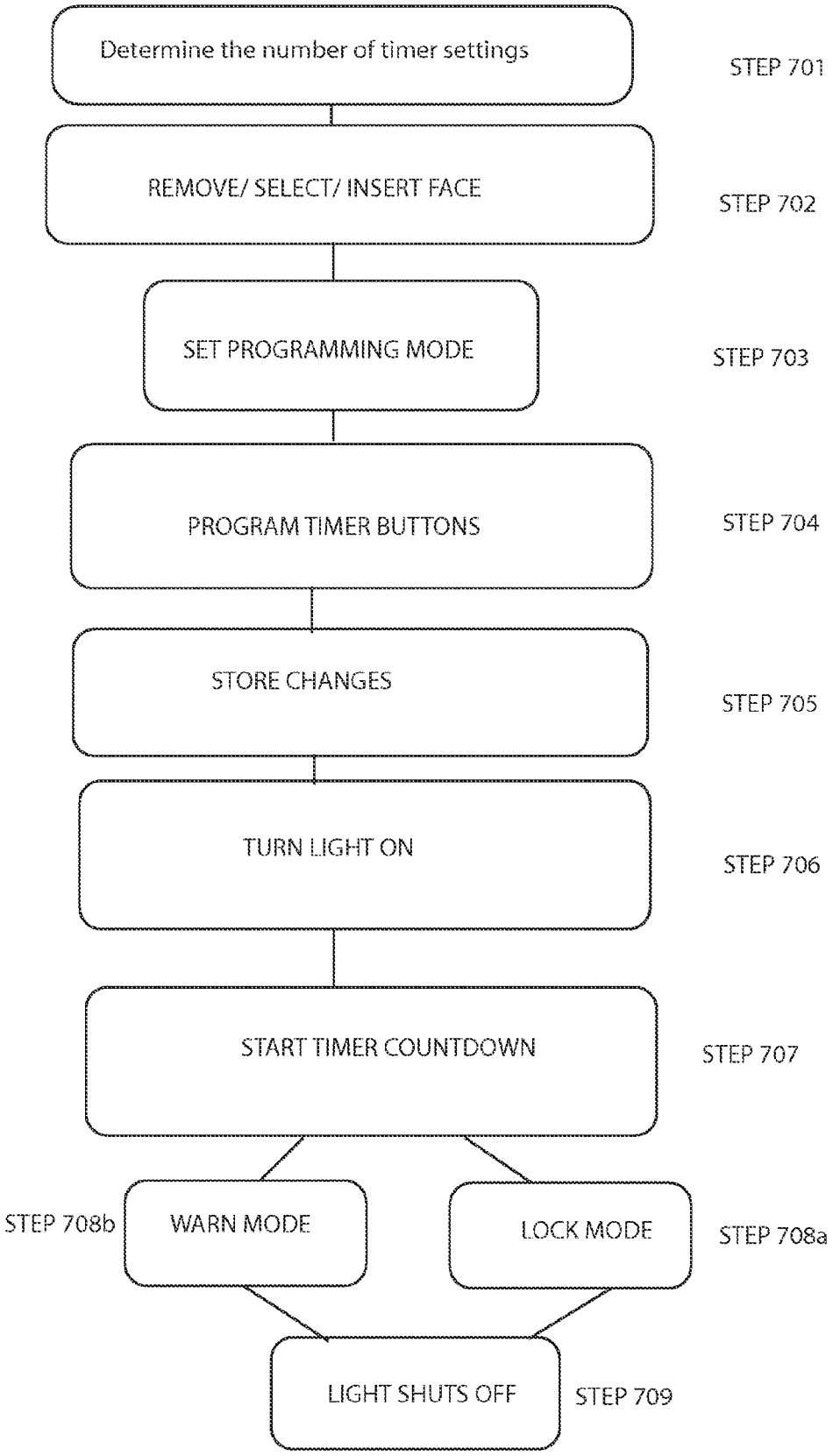
FIG. 7 is a flow chart for programming and using the timer.

FIG. 7 is a flow chart showing an example for programming any one of the elements shown above (such as timers, dimmers, speed controllers, and the like). For example, in step 701 a user would determine the desired number of timer settings. Depending on the desired number of timer settings the user would in step 702 then select or remove a cover plate or face for the timer. The selection of a face is used for both aesthetic reasons and can also be used to set the appropriate number of timer settings or steps for programming in a manner as shown in FIGS. 5 and 6. This step is shown in greater detail in FIG. 8.

Figure 8:
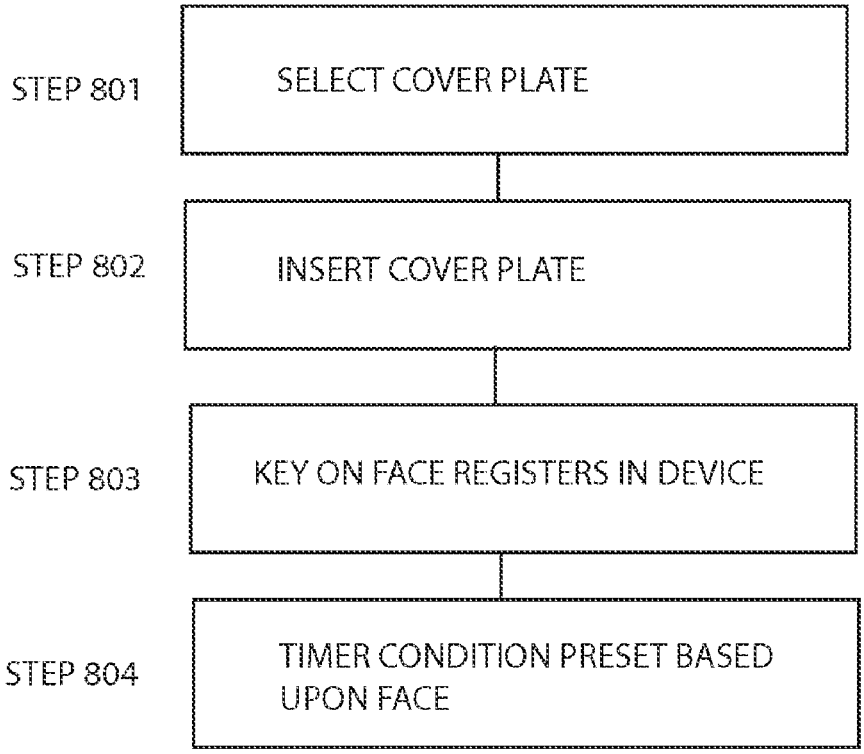
FIG. 8 is a more detailed flow chart for at least one step in FIG. 7.

FIG. 8 shows a more detailed process for step 702. For example, in step 801 a user selects a cover plate from an array of cover plates to cover the housing of the timer. Depending on the type of cover selected, the key is then used to determine the appropriate number of timer settings. Next in step 802 the user inserts the cover plate into the housing. In step 803 the key on the cover plate (such as key 552) registers with the device by interfacing with interface 501. Depending on the section contacted on the interface, a set of signals or instructions are sent to controller 110 to set the timer settings. Next, in step 804 the timer condition is now preset with a preset number of timer settings for the user to either set originally or reset depending on the instructions sent from interface 501 to controller 110. In addition, this key can also be used so that when it interacts with interface 501, it also can optionally set the times for each timer setting.

By setting this cover plate into the device the programming mode is automatically set. Next, in step 703, the programming mode is set either by pressing on particular buttons on the interface or by pressing on buttons on a remote control. The programming mode is essentially a mode where each of the timer, or dimmer, devices is now open to programming changes. Next step 704 includes programming particular timer buttons, so that the incremental times are set.

Steps 701-704 essentially set the timer condition. With the present embodiment, due to the interchangeable cover plate, and the programmable buttons, the timer condition is universally adaptable. A timer condition can be either a characteristic of the number of timer settings that are arranged on a front face, and/or include the predetermined time settings for times as well. For example, depending on the front face, a timer setting can be four sets of times, wherein for example, each incremental timer set is for 20 minute intervals. Thus, there would be buttons and indicators for 80 minutes, 60 minutes, 40 minutes and 20 minutes, based upon these timer conditions. The parameters of these timer conditions can be varied depending on the number of buttons or actuators actually presented, and the preset stored times.

Alternatively, the timer settings can be five different timer settings with any associated timer interval such as 10 minutes, (resulting in a 50 minute button; a 40 minute button; a 30 minute button; a 20 minute button; and a 10 minute button), or six different timer settings with any associated timer interval such as 10 minutes, 15 minutes, 20 minutes or even just 5 minutes as well. These preset settings can be changed after the cover plate installation as well.

Figure 9:
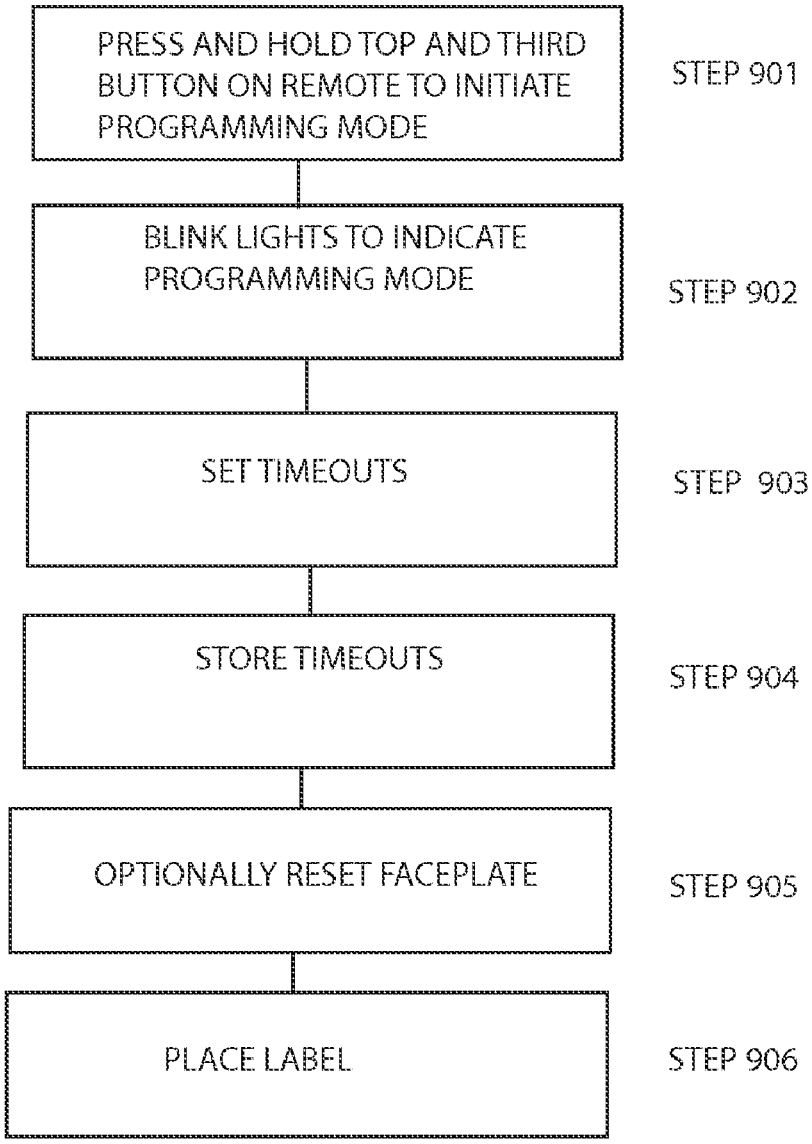
FIG. 9 is a flow chart for at least one step in FIG. 7.
Figure 10:
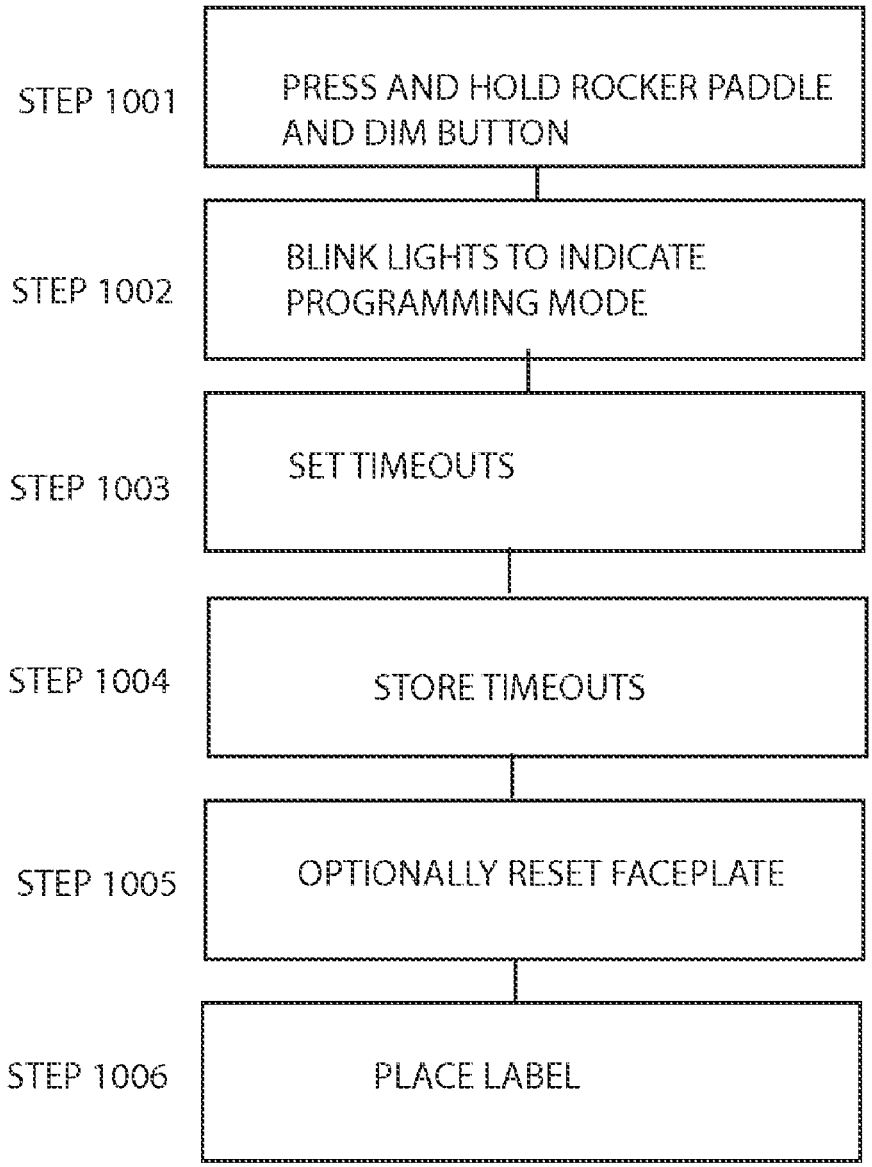
FIG. 10 is a flow chart for another embodiment shown in FIG. 7.

FIGS. 9 and 10 and are flow charts for programming the different embodiments of timers, after the face has been inserted into the housing. For example steps 901 to 906 and steps 1001 and 1006 are more elaborate representations of step 704.

FIG. 9 shows an example of a process for performing step 704, using the embodiments shown in FIGS. 2 and 4. In step 901, a user presses and holds a top, and an adjacent button such as a third button (button 246 in FIG. 2 and button 416 in FIG. 4) to initiate a programming mode. Next, in step 902, the lights blink to indicate that the device is in the programming mode. Next, in step 903, each of the timeout settings are set by pressing and holding onto each button for a period of time and then setting the time through pressing on additional buttons such as one of two adjacent buttons indicating an associated increase or decrease in time.

FIG. 10 is an example of the process for performing step 704 for the timer shown in FIG. 3. FIG. 3 shows a series of timer settings or timeouts 312-326. The setting of these timeouts occurs through step 1001 by pressing either a rocker button 330 and paddle or dimmer button 340 up or down, to start the programming mode. Accordingly, in step 1002 the lights blink indicating that the programming mode has started. Once each of the timeouts is set, in step 1003, a user can store these timeouts in step 1004. The storage of these timeouts is then stored in an associated memory, (See memory 112 in FIG. 1 as an example) which can be part of a controller or a separate unit. Next, in step 1005 the user can optionally change or alter a faceplate by removing a faceplate or inserting a label such as in step 1006 on the faceplate to have new set of designations for the device. In this way, the description on the front of the faceplate can accurately match the designations associated with the timer.

Once all of the times for any one of the processes described above have been set, a user can finally store all of the changes in step 705 (See FIG. 7). Next, in step 706 a user can turn a light on. Next, a user can then initiate a timer countdown in step 707. During this timer countdown, the controller 110 can initiate a lock mode, as disclosed in step 708*a*, wherein a light associated with a particular timer setting would blink indicating that the timer is moving down to the next time interval. Alternatively, in step 708*b*, a user can select a warn mode by pressing and holding a button such as any one of buttons 242-260 or buttons 412 to 418 or 420. The lock mode is for locking the light on or off depending on whether a user presses and holds either a timer button to keep the light on, or an off button to turn the light off.

Alternatively, in the embodiment shown in FIG. 3, the user can press the dimmer button 340 or the rocker button 330 for a predefined period of time so that the timer switches to the lock mode. In this state, the side LEDs go to an off mode so as to indicate a lock mode.

Once this lock mode has been set, there are ways to terminate this mode. For example, a user can turn the lights OFF using a rocker paddle such as rocker paddle 330. Next, the timer turns off along with the side bar display and the last adjusted timeout settings. Next time when the light is turned on, the user may terminate the lock mode by pressing down the rocker down button. In this case, the timer then returns to the previously set timeout settings.

These same steps described in FIGS. 7-10 can be performed using a wireless remote control 150 wherein having the same or substantially similar user interfaces as those shown in FIGS. 2, 3, and 4.

In addition, the steps shown in FIGS. 7-10 can also be adapted so that these steps can be used to program a dimmer as well. For example, a user can select a particular face for a dimmer as described in step 702. Next, to set to programming mode, a user can either insert a particular cover plate, and hold particular buttons such as the top and third buttons as described in step 901 or press and hold the rocker and dim buttons in step 1001.

For example, steps 901-906 can be adapted to address dimmers so that in step 901 a user can press and hold top and third buttons to set the programming modes. Next, in step 902 the lights associated with these buttons would blink to indicate that the device is in a programming mode. Next, in step 903 the dimmer levels can be set and then in step 904 the timeouts can be stored. Next, in step 905 the faceplate can be optionally reset based upon the changes to the dimmer. Finally any labels that are desired can be set so that the necessary indications are applied next to these buttons.

In addition, steps 1001 -1006 can be modified so that they can be used to program a dimmer as well. In this case, as described above, a user can press and hold the rocker paddle and dim button in step 1001 to initiate a programming mode. Next, in step 1002 the lights associated with this device would blink indicating the device is in a programming mode. Next in step 1003 the dimmer settings can be set, as described above. In this case, the dimmer settings are set on a staggered basis which can be based upon the number of buttons where each setting corresponds to a percentage of light level for the dimmer or on an entirely customized level as well wherein each button has its own individual light level. Next, in step 1004 the dimmer levels are stored, wherein in step 1005 the faceplate can then be optionally reset while in step 1006 a label can be placed on the faceplate to indicate the dimmer levels as well.

Overall, these designs create a universally adjustable timer, dimmer, speed control, or other suitable controller, for controlling electronic components such as lights, or other downstream loads. With these designs, the number of timer settings, as well as the individual timer times can be universally set. The three types of setting control can be either with the insertion of a unique faceplate into an interface on the housing, through manual programming via buttons or paddles on the timer itself, or through wireless transmission from a remote control to the device to control the number of timer settings and the time for the settings. The three different types of timer control can be used exclusively to control the time or, on at least one embodiment, any one of the three types of setting control can be used in a partial manner so that the setting of a light can occur partially through insertion of a faceplate, partially through the programming of buttons and partially wirelessly. Through adjustments in the number of timer settings, each time setting and the associated face plate, a user could, with one single timer, create the number of settings and desired time settings that they wish.

Accordingly, while only a few embodiments of the present invention have been shown and described, it is obvious that many changes and modifications may be made thereunto without departing from the spirit and scope of the invention.

What is claimed is:

1. An electrical wallbox mountable self-programmable timer for controlling an electrical load, the timer comprising:

a) a housing adapted to be mounted within the electrical wall box;

b) a controller disposed within said housing c) at least one interface in communication with said controller; and d) a cover plate configured to be removably mounted to said housing, said cover plate further comprising a plurality of buttons configured to change timer setting for the timer, and a key formed integral with said cover plate, said key being arranged and configured to interact with said interface;

wherein when said key contacts said interface said at least one interface sends instructions to said at least one controller to carry out a predetermined set of instructions to change said timer settings for at least one of said plurality of buttons.

2. The timer as in claim 1, wherein said cover plate further comprises at least one extension member, extending from an inside face of said cover plate, wherein said key is coupled to said at least one extension member.

3. The timer as in claim 2, further comprising at least one indicator, wherein said at least one indicator is in the form of at least one light having a light pipe coupled to said at least one light.

4. The timer as in claim 1, wherein said at least one interface has at least one electrical contact such that when said at least one electrical contact is contacted by said key, said at least one electrical contact sends at least one signal to said at least one controller to set an amount of timer settings.

5. The timer as in claim 1 wherein said at least one interface has at least one electrical contact such that when said at least one electrical contact is contacted by said key, said at least one electrical contact sends at least one signal to said at least one controller to set at least one predetermined time for a timer setting.

6. The timer as in claim 1, wherein said at least one interface has at least one electrical contact such that when said at least one electrical contact is contacted by said key, said at least one electrical contact sends at least one signal to said at least one controller to set a number of timer settings, and to set at least one predetermined time for at least one of said timer settings.

7. The timer as in claim 1, further comprising at least one transceiver, and at least one housing which houses said at least one controller, said at least one transceiver, and said at least one interface, and wherein the timer further comprises at least one additional interface coupled to the housing.

8. The timer as in claim 7, further comprising at least one remote control, wherein said at least one remote control is in communication with said at least one transceiver, wherein said at least one remote control further comprises at least one button for setting at least one time for at least one timer setting.

9. The timer as in claim 8, wherein said at least one additional interface includes at least one actuator in communication with said controller.

10. The timer as in claim 9, wherein said at least one actuator is in communication with at least one of the following elements: at least one rocker button; at least one dimmer button; at least one push button, and at least one touch pad.

11. The timer as in claim 1, wherein said at least one cover plate is configured to cover said at least one interface, when said at least one cover plate is mounted on said housing.

12. A process for setting a controller for electrical devices comprising the following steps:

a) determining a number of desired settings for control;

b) setting a predetermined number of controller settings based upon a number of indicators by using a cover plate, an extension member coupled to an inside face of said cover plate and a key coupled to said extension member, said key for interacting with the controller; and c) setting individual settings for at least one of said predetermined number of controller settings such that each individual setting has at least one corresponding indicator of said number of indicators.

13. The process as in claim 12, wherein said predetermined number of controller settings are timer settings that are programmable and settable at a plurality of different times, wherein for at least one indicator of said indicators, a time is set for that associated indicator.

14. The process as in claim 12, wherein said step of setting a predetermined number of controller settings comprises inserting a key into an interface which program the controller to set said predetermined number of controller settings.

15. The process as in claim 14, wherein said step of inserting said key into said interface comprises inserting a cover plate into a housing of the timer wherein said key is coupled to said cover plate and thereby inserts into said interface to set at least one timer time for a timer setting.

16. The process as in claim 15, further comprising the step of wirelessly transmitting signals from a remote control to the controller to modify said at least one timer time.

17. The process as in claim 12, further comprising the step of wirelessly transmitting signals from a remote control the controller to set a predetermined number of timer settings.

18. The process as in claim 15, further comprising the step of setting at least one timer time using the interface comprising at least one button disposed on the housing of the timer.

19. The process as in claim 17, further comprising the step of setting at least one timer time using the interface comprising at least one button disposed on the housing of the timer.

20. The process as in claim 19, wherein said step of setting at least one timer time includes pressing and holding at least two buttons on the interface including an on/off button and at least one of a plurality of buttons taken from the group consisting of a dimmer button and a paddle button.

21. The process as in claim 20, further comprising the step of cycling through a plurality of different programming modes by pressing on at least two buttons including the on/off button and the paddle button.

22. The process as in claim 21, further comprising the step of displaying a particular programming mode by selectively blinking at least one light associated with said on/off button.

23. A timer device for controlling electronic devices and mounted in a wall switch box comprising:

a) a housing in the form of a single gang electrical enclosure;

b) at least one controller disposed in said housing;

c) at least one memory disposed in said housing and in communication with said at least one controller, said memory disposed to store a number of settings, a set of values for each setting and controller instructions for said at least one controller;

d) at least one transceiver disposed in said housing and in communication with said at least one controller;

e) at least one cover plate coupled to said housing;

f) a first interface coupled to said housing, and adjacent to said at least one cover plate;

g) at least one key coupled to said at least one cover plate for interacting with said first interface when said cover plate is inserted onto said first interface;

h) a second interface coupled to said housing;

i) at least one indicator comprising a plurality of lights; and wherein said first interface has at least one contact such that when said at least one contact is contacted by said at least one key, said at least one contact sends a signal to said at least one controller to set said amount of timer settings, and wherein said at least one transceiver is disposed to receiving signals from a remote control to change said amount of timer settings, and to set said times for said timer settings via communication with said at least one controller.

24. The timer device as in claim 23, wherein said at least one cover plate is adapted to receive said at least one indicator, so that said at least one cover plate does not cover said at least one indicator.

25. The timer device as in claim 23, wherein said at least one indicator is in the form of at least one light wherein said cover plate is adapted so that it covers at least one of said at least one light.

26. A timer for controlling electronic devices and mounted in a wall switch box comprising:

a) a housing b) at least one controller disposed in said housing;

c) at least one memory in communication with said at least one controller;

d) at least one wireless communication system coupled to said controller;

e) at least one removable cover plate which is insertable and removable from said housing, said removable cover plate having at least one extension member, extending from an inside face of said cover plate, f) at least one remote control, for programming a set of controller settings in the timer which are stored in said at least one memory;

g) at least one light array disposed in said housing, said light array comprising a plurality of lights coupled to said housing;

h) at least one interface coupled to said housing, said interface comprising a plurality of actuators, wherein said at least one removable cover plate covers at least one of said actuators in said at least one interface; and i) at least one key wherein said at least one key is coupled to said at least one extension member wherein said at least one key is configured to interact with said at least one interface to program a plurality of timer settings when said at least one cover plate is inserted into said housing.

* * * * *